US009206698B2

(12) United States Patent
Naaijkens

(10) Patent No.: US 9,206,698 B2
(45) Date of Patent: Dec. 8, 2015

(54) TURBINE

(71) Applicant: Straaltechniek International N.V./S.A., Aartselaar (BE)

(72) Inventor: Geert-Jan Petrus Naaijkens, Boxtel (NL)

(73) Assignee: Straaltechniek International N.V/S.A., Aartselaar (BE)

( * ) Notice: Subject to any disclaimer, the term of this patent is extended or adjusted under 35 U.S.C. 154(b) by 0 days.

(21) Appl. No.: 13/860,910

(22) Filed: Apr. 11, 2013

(65) Prior Publication Data

US 2013/0336770 A1 Dec. 19, 2013

(30) Foreign Application Priority Data

Apr. 11, 2012 (BE) ..... 20120244

(51) Int. Cl.
*B24C 5/00* (2006.01)
*F01D 5/30* (2006.01)
*B24C 5/06* (2006.01)

(52) U.S. Cl.
CPC ..... *F01D 5/3053* (2013.01); *B24C 5/062* (2013.01)

(58) Field of Classification Search
CPC ..... F01D 5/3053; B24C 5/062
USPC ..... 451/98; 72/53; 241/75
See application file for complete search history.

(56) References Cited

U.S. PATENT DOCUMENTS

| | | | | |
|---|---|---|---|---|
| 2,204,618 | A * | 6/1940 | Peik | 451/97 |
| 2,212,451 | A * | 8/1940 | Peik | 451/97 |
| 2,819,562 | A * | 1/1958 | Barnes | 451/97 |
| 3,745,711 | A * | 7/1973 | Haberlin | 451/97 |
| 3,867,791 | A * | 2/1975 | Goff | 451/97 |
| 3,894,360 | A * | 7/1975 | DeGroot et al. | 451/98 |
| 3,936,979 | A | 2/1976 | Fuerst | |
| 4,174,814 | A * | 11/1979 | Warren et al. | 241/275 |
| 4,249,350 | A * | 2/1981 | Goff | 451/97 |
| 4,355,769 | A * | 10/1982 | Warren et al. | 241/300 |
| 4,397,426 | A * | 8/1983 | Warren et al. | 241/275 |
| 4,480,413 | A * | 11/1984 | Schulte et al. | 451/98 |
| 5,431,753 | A | 7/1995 | Kim et al. | |
| 7,905,766 | B2 * | 3/2011 | Iwata et al. | 451/92 |
| 2009/0053556 | A1 | 2/2009 | Sohn et al. | |
| 2009/0202382 | A1 | 8/2009 | Kim et al. | |
| 2009/0297387 | A1 | 12/2009 | Chin et al. | |

FOREIGN PATENT DOCUMENTS

| | | | |
|---|---|---|---|
| DE | 1062570 | | 7/1959 |
| DE | 10248417 | A1 | 4/2004 |
| DE | 102004023173 | A1 | 12/2005 |
| EP | 0889144 | B1 | 7/2002 |
| EP | 1352713 | A1 | 10/2003 |
| EP | 1543922 | A1 | 6/2005 |
| GB | 743381 | | 1/1956 |

(Continued)

*Primary Examiner* — Maurina Rachuba

(74) *Attorney, Agent, or Firm* — The Webb Law Firm

(57) ABSTRACT

Disclosed is a turbine for a machine for projecting abrasive for the surface treatment of objects. The turbine includes a first flange and a second flange, at least one blade element provided with a guide surface for receiving, guiding and projecting the abrasive, and a mounting system for releasable mounting of the blade element on the flanges. The mounting system includes a support element arranged between the blade element and the flanges and configured for a releasable mounting on the flanges and for supporting the blade element.

22 Claims, 6 Drawing Sheets

(56) References Cited

FOREIGN PATENT DOCUMENTS

| | | | |
|---|---|---|---|
| GB | 2276341 | A | 9/1994 |
| JP | 2006176843 | A | 7/2006 |
| KR | 19940002370 | A | 2/1994 |
| KR | 1020070067593 | A | 6/2007 |
| KR | 1020070067950 | A | 6/2007 |
| KR | 1020090070503 | A | 7/2009 |
| KR | 1020090123229 | A | 12/2009 |
| WO | 2011107204 | A1 | 9/2011 |
| WO | 2011123906 | A1 | 10/2011 |

* cited by examiner

TURBINE

CROSS REFERENCE TO RELATED APPLICATION

This application claims the benefit of Belgium Patent Application No. BE20120244 entitled "Turbine", filed Apr. 11, 2012, which is hereby incorporated by reference in its entirety.

BACKGROUND OF THE INVENTION

1. Field of the Invention

The invention relates to a turbine for a machine for projecting abrasive for the surface treatment of objects. The invention also relates to a support element for such a turbine, a machine for surface treatment of objects and to the use of such a turbine.

2. Description of Prior Art

Such turbines, also referred to as shot blasting turbines or wheel blasting turbines, are used for the purpose of treating the surface of objects, for instance removing a rust layer from metal objects. Such turbines are embodied to drive a quantity of abrasive, consisting for instance of abrasive grains, such as plastic or metal grains, at high speed in the direction of an object in order to blast the surface of the object, for instance with the purpose of removing a layer of paint or rust or the like present on the object. The abrasive is introduced into the centre of a rotating turbine, after which a number of blades arranged in the turbine entrain the abrasive. The abrasive leaves the turbine via the radial side thereof.

Examples of such shot blasting turbines are described in the patent documents WO 2011/123906 A1, WO 2011/107204 A1, EP 1 543 922 A1 and GB 2 276 341 A. The turbines in WO 2011/123906 A1 and EP 1 543 922 A1 are provided with substantially straight, radially extending impeller blades or forward curved impeller blades. The forward curved blades have the advantage, among others, relative to the straight blades that at a constant rotation speed of the turbine wheel more kinetic energy can be imparted to the abrasive. Described in EP 1 543 922 A1 is a shot blasting machines in which impeller blades are applied having a substantially Y-shaped guide surface. An advantage of this type of impeller blade is that the turbine can be rotated both left and right in order to project the abrasive.

The blades of the turbines are manufactured from a hard wear-resistant material because of the high wear resistance required in order to maintain a relatively high uptime.

The turbine described in GB 2 276 341 has blades wherein each of the blades are mounted via two elongate studs (FIG. 11) provided on either side in corresponding recesses in the flanges of the turbine wheel. A drawback of this mounting method is that, as a result of a relatively small contact width, i.e. the distance (width) over which the blade is supported with the studs on either side by the flanges, is relatively small. The contact width corresponds roughly to the width of the studs themselves.

The turbine described in the document DE 1 062 570 B has a similar drawback. The blades are supported in radial recesses in the flanges of the turbine. The blades are supported only at the position of their longitudinal edges. The blades of the turbine described in EP 1 352 713 A1 have studs on their longitudinal sides which can be arranged in radial recesses in the flanges. This means that the blades are supported only via the lateral studs.

Known from the British patent GB 743 381 A is a turbine with blades which are supported only on one side. The turbine has a single flange, wherein an L-shaped support is screwed fixedly to the flange. The L-shaped support is placed behind a blade and supports it during rotation of the turbine. The support can extend behind the whole width of the blade. The support itself will however begin to bend under the influence of the (centrifugal) forces, so that relatively large peak stresses will in turn also occur at the position of the connection of the blade and the support to the flange. These peak stresses can cause wear and thereby limit the lifespan of the turbine. Cases are even known where the peak stresses have resulted in damage to the blades, or even breaking thereof.

Also described in U.S. Pat. No. 3,936,979 is a turbine supported on only one side. The turbine has a single rotor plate to which a bracket is screwed. The support has an L-shaped cross-section and supports the blade over only a part of the width thereof. The known turbine therefore also has relatively high peak stresses in the blade, particularly close to the connection of the support to the rotor plate.

In the shot blasting machine described in document EP 1 543 922 A1 each of the blades is also supported on the side walls of the turbine with a relatively small contact width. Owing to the limited contact width each blade has relatively small supporting surfaces with which the blade is supported by the flanges. The consequence hereof is that relatively high stresses occur in the material of the blade, and in particular at the position of the edge of the supporting surfaces. In practice these stresses limit the maximum dimensions of the turbine.

A further drawback of the known shot blasting machine is that the mounting of the blades on the flanges, for instance the above stated elongate studs on either side of the guide surface of the blades, and thereby the supporting surfaces with which the blades are supported, can wear during use due to abrasive passing therealong. Wear also occurs when the blades and the associated mounting are manufactured from a hardened material. This may mean that the blades are already so worn after relatively short-lived use that they have to be replaced.

A further drawback of the known blades is that the blades themselves are mounted directly on the flanges of the turbine. When a blade has to be replaced, for instance because it is worn, this often means in practice that the whole turbine wheel must be disassembled to enable removal of the blade from the turbine part. This is labour-intensive and also limits the available uptime of the shot blasting machine.

A further drawback of the known shot blasting machines is that, due to the decrease in the mass of the component, for instance a blade, particularly at determined locations where wear is greater than elsewhere, imbalance can occur in the turbine. If the imbalance in the turbine becomes too great, this can have an adverse effect on the bearing-mounting of the turbine. This can result in the turbine having to be reconditioned, this entailing high cost and less available uptime.

The application of wear-resistant materials in the known blades has the further drawback that such wear-resistant materials, such as ceramic or hard metal, have a poor dimensional stability. It is difficult, and at the very least highly costly, to manufacture a blade which has on the one hand a high wear resistance and can on the other be precisely manufactured such that little play occurs in the turbine, for instance at the position of the connection of the blade to the flanges of the turbine. The application of blades of ceramic material or hard metal means in practice that a relatively large amount of play occurs, which can result in imbalance in the turbine.

It is an object of the present invention to provide a turbine, mounting and/or machine in which at least one of the above stated drawbacks is obviated or reduced.

Is also an object of the invention to provide a turbine, mounting and/or machine in which the stresses at the location of the supporting surfaces can be reduced.

It is also an object of the invention to provide a turbine, mounting and/or machine with an extended available uptime.

It is also an object of the invention to provide a turbine, mounting and/or machine in which the blade element can be removed or exchanged quickly and easily, wherein particularly the turbine, or even the turbine wheel itself, need not be disassembled.

It is a further object of the invention to provide a turbine, mounting and/or machine which has relatively little problem with imbalance, even after prolonged wear due to the abrasive.

SUMMARY OF THE INVENTION

According to a first aspect of the invention, a least one of the above stated objectives is achieved in a turbine for a machine for projecting abrasive for the surface treatment of objects, wherein the turbine comprises a turbine wheel rotatable about a central axis, the turbine wheel comprising:

- a first flange and a second flange, wherein at least one of the flanges is provided with a supply opening along which the abrasive can be supplied;
- at least one blade element arranged between the first and second flanges and provided with a guide surface for receiving, guiding and projecting the abrasive supplied via the supply opening;
- a mounting system for releasable mounting of the blade element, wherein the mounting system comprises:
  - a support element which is arranged between the blade element and the flanges and which is mounted releasably on the blade element and on each of the flanges, wherein the support element is arranged at a position behind the blade element and is embodied to support the blade element at least in an area located centrally between the flanges.

The support element is embodied to support the blade element at least in the central area or, in other words, roughly around the centre of the width of the blade element, in order to thus reduce the peak stresses at the edges of the blade element.

Alternatively or additionally to the central support by the support element, the support element can be embodied and arranged to support the blade element over substantially the whole width. Because in this embodiment the blade element comprises a part which is supported by the support element substantially over a large part of the width or even over the whole width thereof (i.e. over substantially the whole distance between the two flanges), the forces occurring as a result of the rotation of the turbine wheel can be absorbed over a greater contact width. The width of the support element and of the blade element preferably correspond substantially to the intermediate distance between the two flanges, so that advantage can be gained from a maximal contact width.

The term "central axis" is understood here to mean the imaginary axis about which the turbine wheel can rotate. Depending on the specific construction of the shot blasting machine, the central axis may however also refer to a physical drive shaft.

In determined embodiments the width of the guide surface of the blade element substantially corresponds to the intermediate distance between the flanges, or is slightly smaller. The forces on the blade element are then transmitted wholly or for the greater part via the line contacts over the width of the blade element.

The support element is preferably embodied releasably of the blade element. This has a number of advantages. It is possible to replace the blade element, for instance when it is worn, wherein the support element can remain in place. In determined embodiments it is even possible to release the blade element without the support element having to be detached from the flanges. A further advantage is that the support element and the blade element can be manufactured from different materials with different material properties. As will be set forth below, this makes it possible to individually optimize the blade element and the support element for the tasks for which they are intended, i.e. for entraining abrasive and for providing a good support and mounting on the flanges of the turbine. A further advantage is that, since the support element is arranged behind the blade element in the direction of rotation, the support element is protected by the blade element from the influence of the abrasive, and there is therefore less chance of it being damaged as a result of wear.

In determined embodiments of the invention the blade element is embodied substantially for the purpose of absorbing compression stresses. The compression stresses are the consequence of the centrifugal force on the blade which results from the rotation of the wheel, and of abrasive sliding along the surface of the blade element. The material of the blade element is then chosen such that it can well withstand wear (i.e. is wear-resistant), this often having the result that it is particularly suitable for absorbing compression stresses. Conversely, the support element is preferably embodied substantially for the purpose of absorbing shear and tensile stresses. The shear stresses occur for instance at the location of the mounting of the support element on the flanges of the turbine. The material of the support element is then chosen such that it can also well withstand shear stresses.

In embodiments of the invention the blade element is manufactured from a relatively wear-resistant and brittle material, for instance a ceramic material or hard metal, and the support element is manufactured from a relatively tough material, for instance (hardened) steel/metal alloy.

According to an embodiment the blade element is embodied releasably from the support element. When a blade element has to be replaced, for instance because it is worn, the support element can remain in place and only the blade element need be detached from the support element. In determined embodiments it is even possible to exchange the blade element in a situation where the support element is mounted on the flanges. This may mean that the turbine wheel need not be disassembled and/or that the blade elements can be exchanged without the turbine wheel having to be uncoupled from the rest of the machine.

The mounting system can comprise:

- a support element with one or more through-openings;
- mounting elements for placing in one or more of the through-openings for mounting the support element on both flanges.

The mounting elements are wholly enclosed here by the support element in the space between the flanges, so that they are well protected against the wearing effects of the abrasive particles.

In embodiments of the invention the support element with mounting elements forms substantially the only coupling between the two flanges. This means that no separate coupling pieces are necessary between the two flanges in order to hold them together. The absence of such coupling pieces can further mean that less turbulence occurs in the space between the blades. Turbulence may cause the abrasive to adversely affect the surface of the support body.

A further advantage is that the part of a mounting element extending between the flanges can be substantially wholly enclosed by a support element. This means a greatly reduced chance of damage to the mounting element, for instance as a result of wear caused by the influence of the abrasive. It is further possible to form the support element in smooth manner (e.g. without protruding parts) and/or in rounded manner such that there is less chance of turbulence on the lee side of the support element, which turbulence could cause wear of the surface of the support element.

In determined embodiments of the invention the support element comprises an edge part positioned at the distal outer end relative to the central axis. This edge part forms a stop against which the blade element rests in operative state. The above stated one or more through-openings are provided here at a relatively great distance from this stop in order to obtain a good and uniform distribution of forces from the blade element onto the support element. It has been found that in determined embodiments the one or more through-openings must be a distance removed from the stop of at least once the diameter of the through-opening in order to enable a suitable support. In order to distribute the forces still better, to improve reliability and/or reduce wear, the distance is however preferably at least twice, three times or even more than three times greater than the characteristic diameter of a through-opening (and a mounting element arranged therein).

The guide surface of the blade element can have a proximal outer end close to the central axis for the purpose of receiving abrasive, and a distal outer end remote from the central axis for the purpose of projecting abrasive. Between the two outer ends the guide surface can take a curved form (preferably forward curved, wherein the concave front side of the blade element is oriented in the rotation direction of the turbine) in order to be able to impart more kinetic energy to the abrasive.

The support element can comprise a recess on the side facing toward the blade element. This recess is formed here such that a corresponding protruding part of the blade element can be at least partially received therein, for instance by sliding the protruding part into the recess. The protruding part and the recess can be formed such that, when the turbine wheel is rotated and the blade element is pressed against the support element as a result, the blade element remains resting in stable manner on the support element. When the support element comprises a first and a second edge part, wherein the first and second edge parts respectively extend distally and proximally relative to the central axis, the first edge part can form a stop against which the blade element rests during operation. The second edge part can also form a stop against which the blade element rests during operation. In such an embodiment the blade element can rest in stable manner against said stops during rotation of the turbine wheel.

In embodiments of the invention the support element comprises a first edge part, central part and second edge part manufactured integrally. During rotation of the turbine the greatest force is exerted on the first (distal) edge part of the support element by the blade element as a result of the centrifugal forces which occur. In said embodiment this edge part is formed integrally with the central part and therefore has a great structural strength. This ensures that the support element can extremely easily withstand the centrifugal forces that occur. Use is preferably not made of vulnerable parts, for instance movable parts for fixing the blade element, at the position of the first (distal) edge part.

The shape of the recess can for instance substantially correspond to the shape of the protruding part and/or the protruding part and the recess can for instance have a mutually releasing form. In a specific embodiment the support element takes a substantially C-shaped form.

In determined embodiments the recess, and preferably also the protruding part, extend over substantially the whole intermediate distance between the first and second flanges. One or more line couplings are hereby realized when the blade element is pressed against the support element under the influence of the centrifugal forces. The line contact can extend over the whole width of the blade element.

In embodiments of the invention two line contacts are realized. The first line contact is made between the surface of the edge part facing toward the central axis and the corresponding part of the blade element. The second line contact is made between the surface of the edge part oriented in tangential direction and the corresponding part of the blade element.

Although the blade element can rest in stable manner on the support element when the turbine wheel is rotated, this need not necessarily always be the case. In determined embodiments there is the possibility of the blade element detaching from the support element when the turbine wheel is stationary. Partly for the purpose of avoiding this situation, in a further embodiment fixing means are provided for fixing the second edge part relative to the support element so that the blade element also remains better in place when the turbine wheel is stationary. The fixing means can comprise a spring for fixing the blade element under spring tension to the support element. The fixing means can also comprise an opening with associated fixing pin provided in the support element. This fixing pin can for instance be screwed into the opening, wherein the outer end of the pin presses against the blade element in order to fix the blade element in the recess of the support element.

The fixing means are preferably provided at the position of the second edge part. Fixation then takes place at the proximal outer end of the support element, i.e. the part of the support element located closest to the rotation axis.

According to embodiments of the invention, the support element is on the one hand structurally at its strongest where the greatest forces occur (i.e. at the position of the distal part) and the relatively vulnerable fixing means are on the other hand situated at a position (i.e. the position of the proximal part) where the speed of the abrasive particles is relatively low, and the wear resulting from these abrasive particles is therefore limited.

In embodiments of the invention the blade element can be biased in play-free manner in substantially radial direction onto corresponding contacts in the support element intended for this purpose. The blade element is pressed against the support element as a result of the bias. In these embodiments less strict standards can therefore be set for the dimensional stability in the blades. Biasing can for instance take place using the above described fixing means.

Steel dust (residue of the shot or abrasive) from the shot blasting machine is circulated by the turbine, and this can result in wear at different locations in the machine. In order to avoid excessive wear of the support element at the distal outer end by this steel dust, the shape of the support element is chosen such that this outer end of the support element remains within the circular form defined by the turbine wheel and/or the blade elements. The path of the projected particles is then such that there is little chance of the particles coming into the vicinity of the upper side of the support element.

In embodiments of the invention the distal outer end of the support element relative to the central axis has a free first end surface, the normal of which extends radially or obliquely to the rear. Additionally or instead, the distal outer end of the support element relative to the central axis comprises a second end surface which is wholly shielded by the blade element and the normal of which extends forward (i.e. in the direction of the rotation). Where the normal extends forward, the support element is wholly shielded by the blade element so that this part of the support element is not subject to wear, or hardly so. The other part of said outer end not covered by the blade element has a surface which is oriented such that the degree of wear is relatively small. This is because the normal of the surface extends in radial direction or to the rear (relative to the rotation direction), and so the chance of turbulence and the wear by the abrasive particles occurring as a result is reduced. A possible impact of abrasive particles will moreover involve less collision force, which can result in less wear.

In a further embodiment the support element is mountable at least at one mounting point, preferably two mounting points, on a flange. The mounting points are preferably located in the operative state at more than twice or three times, for instance between five and ten times, the thickness of the blade element relative to the rear side of the blade element. These mounting points are therefore localized a significant distance behind the blade element as seen in the rotation direction, so that the mounting at these mounting points, formed for instance by metal shafts which can be anchored in the flanges of the turbine wheel, are not likely to be affected by abrasive undesirably running along the blade element.

In a further embodiment the radial distance between the central axis and each of the mounting points amounts to less than 80% of the radial distance between the central axis and the distal outer end of the blade element. Since the speed of the turbine wheel increases as the radial distance relative to the central axis increases, and the degree of wear increases with the speed of the abrasive, the mounting points are position at relatively small radial distance relative to the central axis.

In a determined embodiment the proximal outer end of the blade element is situated a shorter distance from the central axis than the proximal outer end of the support element, this in order to protect the support element so that the proximal outer end of the support element is less adversely affected by abrasive. In a further embodiment the proximal outer end of the blade element protrudes so far relative to the proximal outer end of the support element that in the operative state the abrasive substantially does not make contact with the proximal outer end of the support element. This greatly reduces the risk of damage to the support element by direct blasting with the abrasive.

According to a second aspect, the invention also relates to the mounting system as already described above. The mounting system comprises a support element attached between the blade element and the flanges, wherein the support element is embodied releasably from the blade element and is arranged behind the blade element.

In an embodiment of the invention the system comprises a support element embodied to support the blade element over at least 50%, and preferably over substantially the whole width, of the blade element.

According to a third aspect of the invention, a machine is provided for projecting abrasive. The machine comprises at least one turbine as described herein and a drive for rotatable driving of the turbine wheel, wherein the drive comprises for instance an electric motor connected via the motor shaft or via a drive shaft to the turbine.

BRIEF DESCRIPTION OF THE DRAWINGS

Further advantages, features and details of the present invention will be elucidated on the basis of the following description of several embodiments thereof. Reference is made in the description to the accompanying figures, in which.

DETAILED DESCRIPTION OF THE INVENTION

Figure 1:
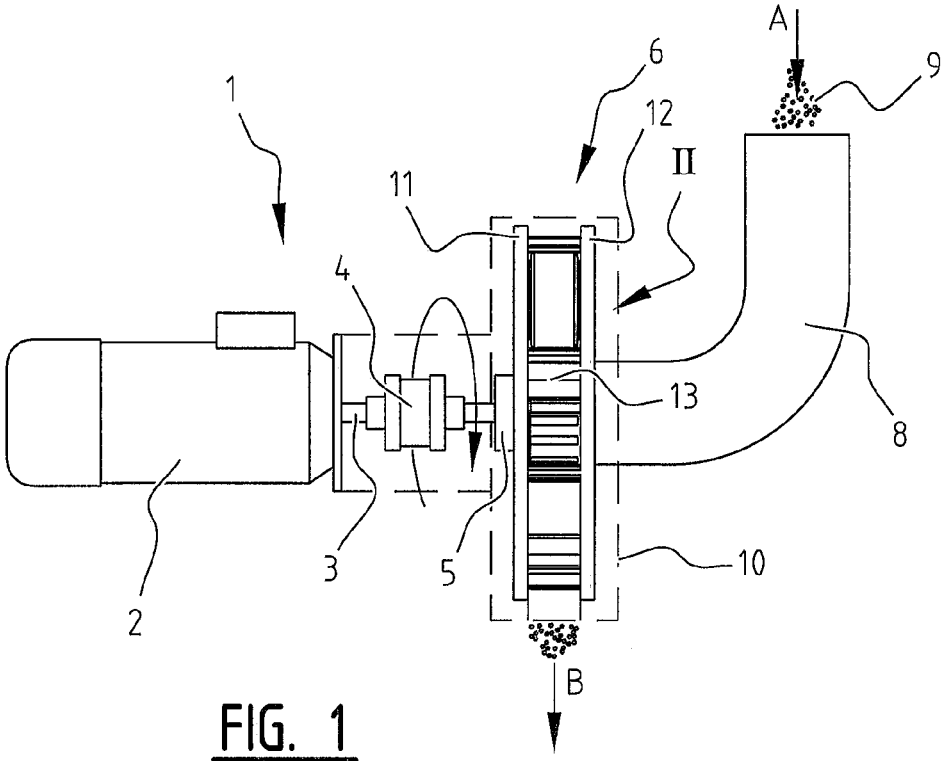
FIG. 1 shows a view of a part of a machine according to an embodiment of the invention.

FIG. 1 shows a partially cut-away view of a shot blasting machine 1. The shot blasting machine comprises an electric motor 2, the output shaft 3 of which is coupled via a transmission 4 and a drive shaft 5 to a turbine 6 with a rotatable turbine wheel. The figure also shows a feed 8 for feeding (direction A) abrasive, for instance a quantity of particles or grains 9, with which an object (not shown) can be blasted. Both the electric motor 2 and feed 8 are attached to a frame. For the sake of simplicity the frame is not shown in the drawing. A housing 10 can be arranged around turbine 6. The abrasive supplied via feed 8 is received and set into rotation by turbine 6 in the manner described below. The abrasive is projected out of the turbine in the direction (B) of an object for treatment.

Figure 2:
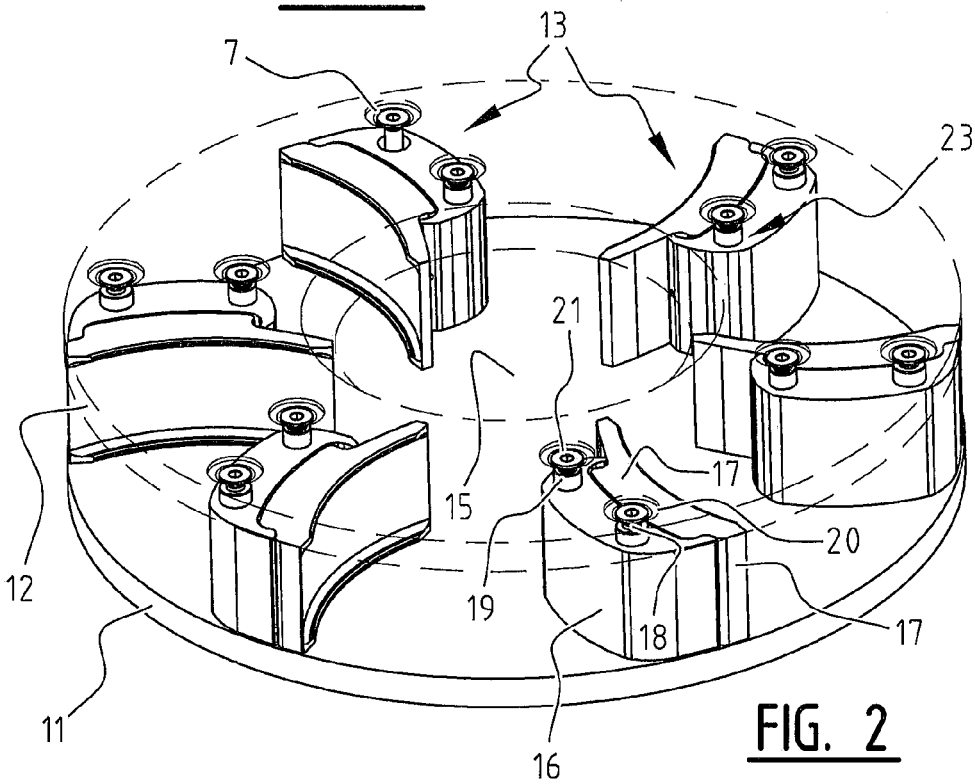
FIG. 2 is a partially cut-away perspective view of the turbine of the embodiment shown in FIG. 1.
Figure 3:
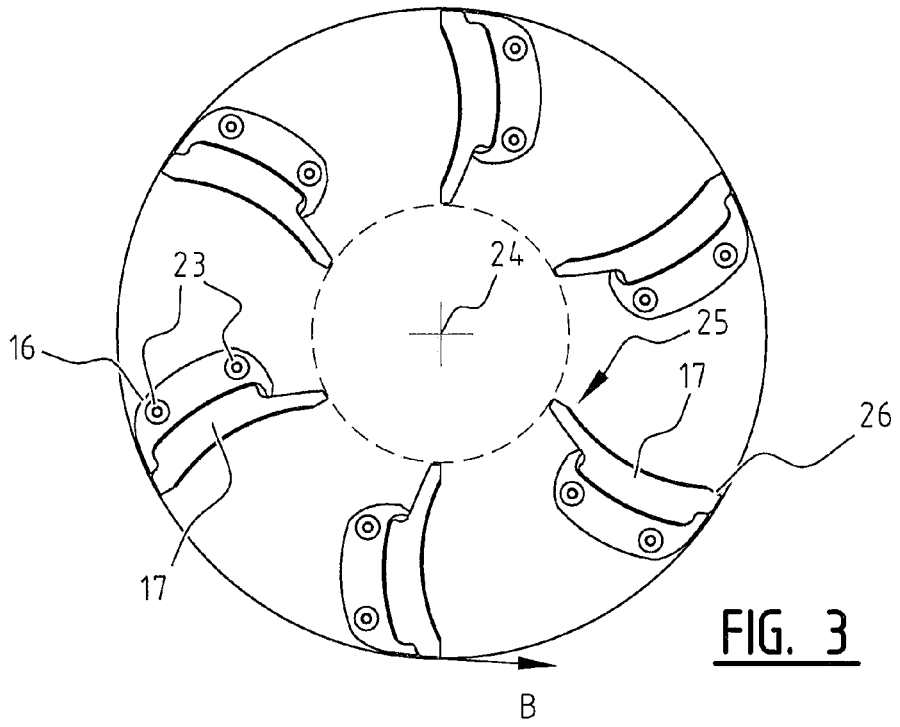
FIG. 3 is a schematic side view of the turbine of FIG. 2.
Figure 7:
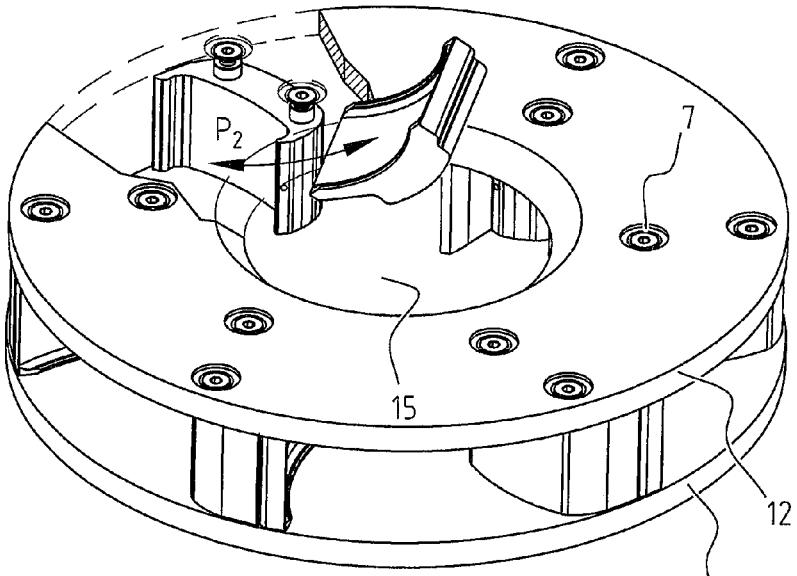
FIG. 7 is a partially cut-away perspective view of a turbine in which the replacement of a blade element is shown.

The turbine 6, which is shown in more detail in FIGS. 2, 3 and 7, comprises two substantially disc-like flanges 11, 12 between which a number of blades 13 are arranged. In the shown embodiment the turbine is provided with six blades 13. Other numbers of blades are of course also possible.

The first flange 11 is coupled to output shaft 5 which is connected to electric motor 2. The rotation of output shaft 3 of electric motor 2 is therefore transmitted via transmission 4 to the first flange 11. The second flange 12 generally has substantially the same form but is provided in the centre with an opening 15. The edge of opening 15 can connect in known manner to feed 8 and is suitable for admitting the abrasive 9 therealong into turbine 6. The abrasive enters the intermediate space between the two flanges 11, 12 and is entrained by blades 13.

Figure 4:
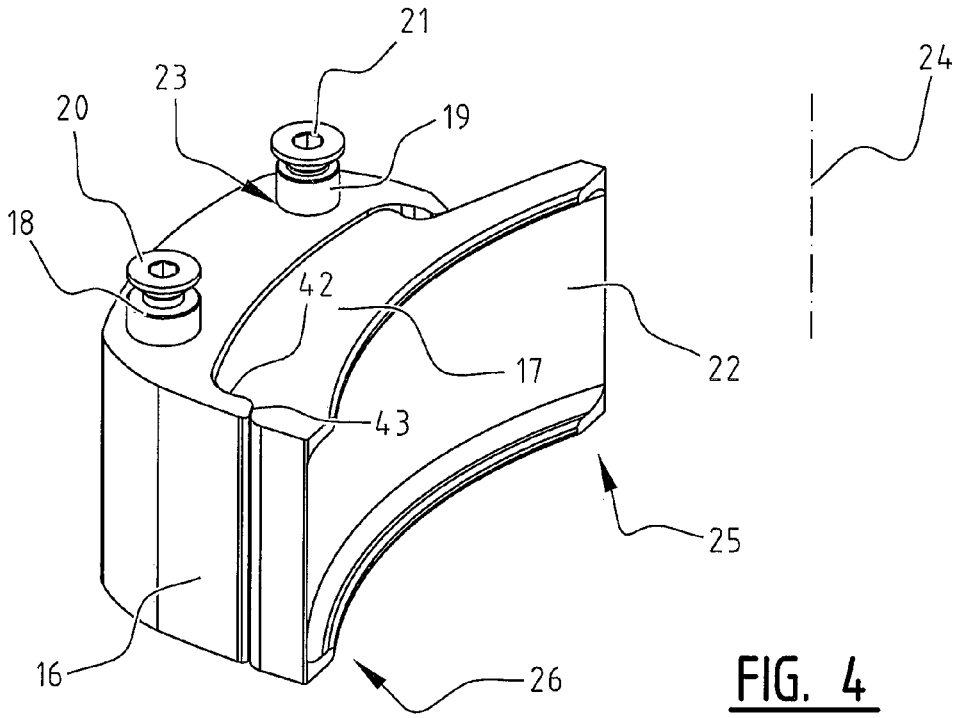
FIG. 4 is a perspective view of an embodiment of a blade element and a support element according to an embodiment of the invention.

An embodiment of a blade 13 is further described below referring to FIGS. 2 and 3, and in particular to FIG. 4. A blade 13 comprises the actual blade element 17 and a support element 16 positioned behind it (wherein the turbine wheel is displaced in forward direction so that the support element as it were pushes the blade element forward). Blade element 17 comprises on the front side (relative to the rotation direction) a guide surface 22 curved wholly or partially forward. Guide surface 22 has the function of guiding the abrasive along the blade. The closest (proximal) outer end 25 of guide surface 22 of blade element 17 relative to central axis 24 (FIG. 3) is configured to receive the grains. A second (distal) outer end 26 of guide surface 22 positioned further from central axis 24 is configured to project the grains with great energy in the direction of the object for treatment. A protruding part 30 is provided between the proximal outer end 25 and the distal outer end 26 on the rear side, i.e. on the side opposite guide surface 22. In the shown embodiment the protruding part is formed over the whole width of blade element 17. In the shown embodiment the protruding part has a block shape, wherein the edges of the block shape take a form which is rounded to some extent, this being shown particularly clearly in FIGS. 5 and 6. The protruding part can however also take other shapes. What is important is that the protruding part, together with the shape of the support element, can ensure that in operative state, when the turbine is rotated at high speed, the blade element is supported in stable manner by the support element.

In the shown embodiment blade element 17 is not mounted directly on flanges 11, 12 of turbine 6. Blade element 17 is mounted on the flanges via a connecting piece in the form of the above stated support element. Support element 16 has a slightly smaller width than blade element 17. The support element is further provided with a central recess 53. The central recess 53 is flanked by two edge elements, i.e. a distal edge element 37 and a proximal edge element 36 (relative to central axis 24). Edge elements 36 and 37 likewise extend over substantially the whole width of the blade element and form together with recess 53 a receiving space in which the above stated protruding part 30 of blade element 17 can be arranged in optionally fitting manner.

Support element 16 is provided with a number of through-openings 23. Shafts 18, 19 are arranged in said through-openings 23. Shafts 18, 19 are provided on the outer ends with a recess which is provided with screw thread and into which a nut 20, 21 can be screwed. Shafts 18, 19 fit into openings 7 provided in the respective flanges 11, 12, and the above stated nuts 20, 21 are screwed from outside onto the shafts so that the support element can be fixed firmly between the two flanges 11, 12.

Figure 5:
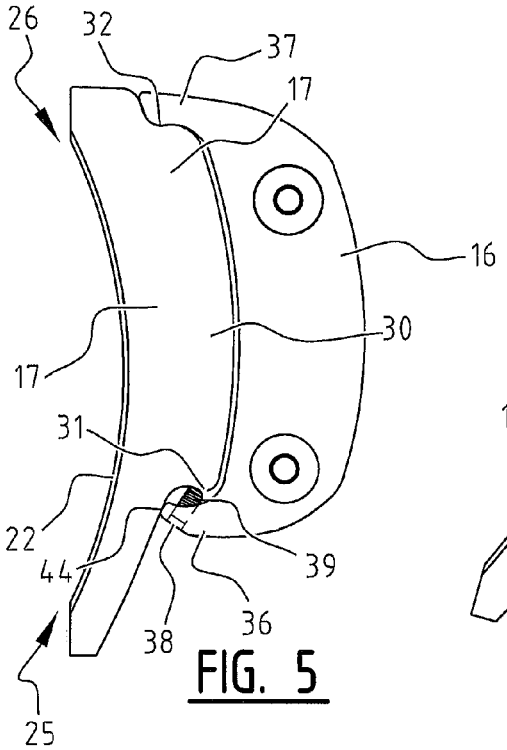
FIGS. 5 and 6 show views of the embodiment of the blade element and the support element in respectively a fixed and non-fixed situation.

Due to the matching shape of the protruding part of blade element 17 and that of recess 53 of the support element the protruding part 30 can be arranged more or less fittingly in the recess. At the distal outer end 26 of blade element 17 the side wall 32 of protruding part 30 rests against the distal edge element 37 of the support element (FIG. 5). At the proximal outer end of stud 30 the side wall 31 is placed some distance from the proximal edge part 36 of support element 16. This distance is necessary to enable sliding of blade element 17 into recess 53 of support element 16 or, conversely, to slide the protruding part 30 thereof out of support element 16 (in the direction of $P_1$, FIG. 6).

Figure 6:
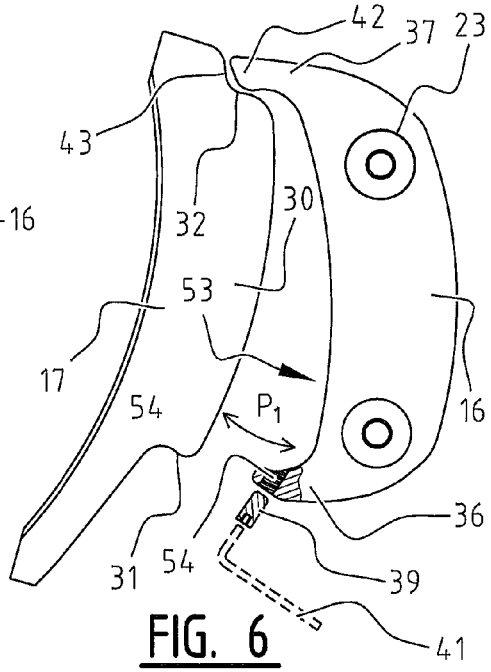

Shown in FIGS. 5 and 6 is how a blade element 17 which has been slid into the central recess in the support element can be fixed in the inserted position. In determined embodiments the blade element will continue to support on the support element without further technical measures. In other embodiments or situations additional fixing of the blade element may be necessary.

In order to ensure that blade element 17 does not detach undesirably from recesses 53, for instance when turbine 6 is stationary and blade element 17 is not being pushed against the distal edge element 37 of support element 16 as a result of the centrifugal forces, blade element 17 can be fixed at the proximal part relative to support element 16. In a determined embodiment (not shown) a spring is provided between the proximal edge part 36 and the protruding part 30 of blade element 17 for the purpose of holding the two elements 16, 17 under spring tension relative to each other. In the embodiment shown in FIGS. 5 and 6 however, support element 16 is provided with a recess 54. The wall of the recess is provided with screw thread so that a pin with external screw thread 39 (FIG. 6) can be screwed therein using a tool 41. Blade element 17 can hereby be clamped fixedly to support element 16 (FIG. 5).

In determined embodiments the fixing means are further applied to compensate the play present between the support element and the blade element, for instance as a result of a lack of dimensional stability of the blade element. The fixing means then provide for a bias on the line contacts at the top (at the distal outer end of the support element) and the line contact at the bottom (at the proximal outer end of the support element).

The removal of a blade element 17, for instance to exchange it for a new blade element when the old blade element is worn, can take place quickly and easily. Screw 39 is first of all unscrewed so that the underside (the proximal part) of blade element 17 can be removed from recess 54 ($P_1$). The whole blade element 17 can then be removed, for instance by being displaced radially outward via the open space between flanges 11 and 12 or by being slid outward via central opening 15 as shown in FIG. 7 (direction $P_2$). This makes it possible to replace one or more of the blade elements 17 without turbine wheel 6 having to be uncoupled from the shaft of the drive, or even without one or more of the flanges 11, 12 having to be disassembled. Time and cost can hereby be saved. Fixing of the blade element 17 relative to support element 16 (for instance by means of screw 39) at the position of the proximal part moreover ensures that the mounting, often seen as vulnerable, is subject to little or no wear by the abrasive. Little or no abrasive will in practice reach the mounting point at the position of the mounting.

When the turbine begins to rotate, at the distal outer end of the blade element substantially two line contacts will occur over the whole width of the blade element. A first line contact 55 (FIG. 9) is formed by side wall 32 pressing against the distal edge part 37 as a result of the centrifugal forces. A second line contact 56 is formed by the leading surface 42 of edge part 37 which presses against the corresponding surface 43 of distal part 26 of blade element 17 to cause rotation of the blade element. In contrast to the situation in the prior art, the contact width resulting from these two line contacts is substantially equal to the width of the blade. The stress in the blade is hereby reduced. A line contact 44 between support element 16 and blade element 17 is formed in similar manner at the position of the proximal outer end of the blade element.

Figure 10A:
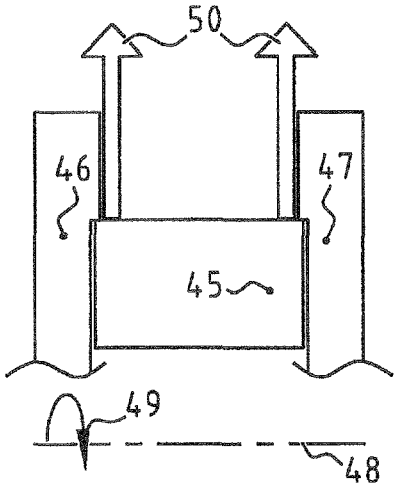
FIGS. 10A and 10B are schematic views of a turbine according to respectively a prior art example and an embodiment of the invention, wherein the difference in the stresses occurring is shown.
Figure 10B:
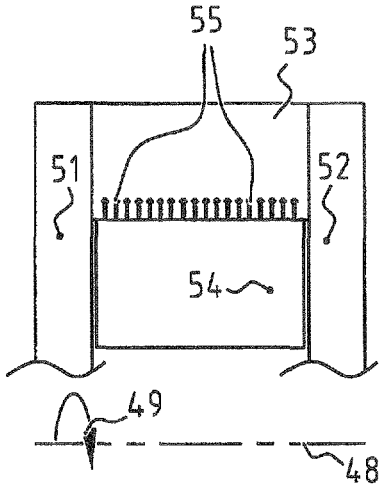

Shown by way of illustration in FIGS. 10A and 10B is the influence which the support over the whole width of the blade element has on the stresses occurring in the blade element. FIG. 10A shows a schematic cross-section through a blade 45, a left flange 46 and a right flange 47 according to the prior art. The entity of blade and flanges rotates in direction 49 around an imaginary rotation axis 48. The blade is supported on the longitudinal sides in recesses provided in the respective inner surfaces of the flanges. At the position of the connection of the blade to each of the flanges relatively high peak stresses (indicated with 50) occur during rotation of the turbine. FIG. 10B shows an embodiment according to an aspect of the invention. Here the blade 54 is supported by a support element 53 placed behind the blade and extending over the whole width of the blade. Support element 53 is in turn mounted on the two flanges 51 and 52. In this construction the blade element is supported over the whole width by a support element and the support element is mounted on either side on the flanges. The stresses 50 occurring are now distributed more uniformly over the width of blade 54. The blade and/or the support element can hereby be given a longer lifespan and/or the risk of the blades breaking is significantly reduced.

As discussed above, the residue of the shot or the abrasive is set into turbulence by turbine wheel 6. Owing to this turbulence this residue will wear away anything which comes into contact with it. The turbine, for instance the flanges thereof, is therefore manufactured in many cases from a wear-resistant material. This does not however prevent some wear still occurring, for instance at the location of the supporting surfaces. By enlarging the contact surface by means of the above described C-shaped support element and by placing the support element directly behind the blade element (as seen in the rotation direction) the mounting of the blades on the flanges of the turbine is better protected from the influences of the abrasive (and the steel dust).

Figure 8:
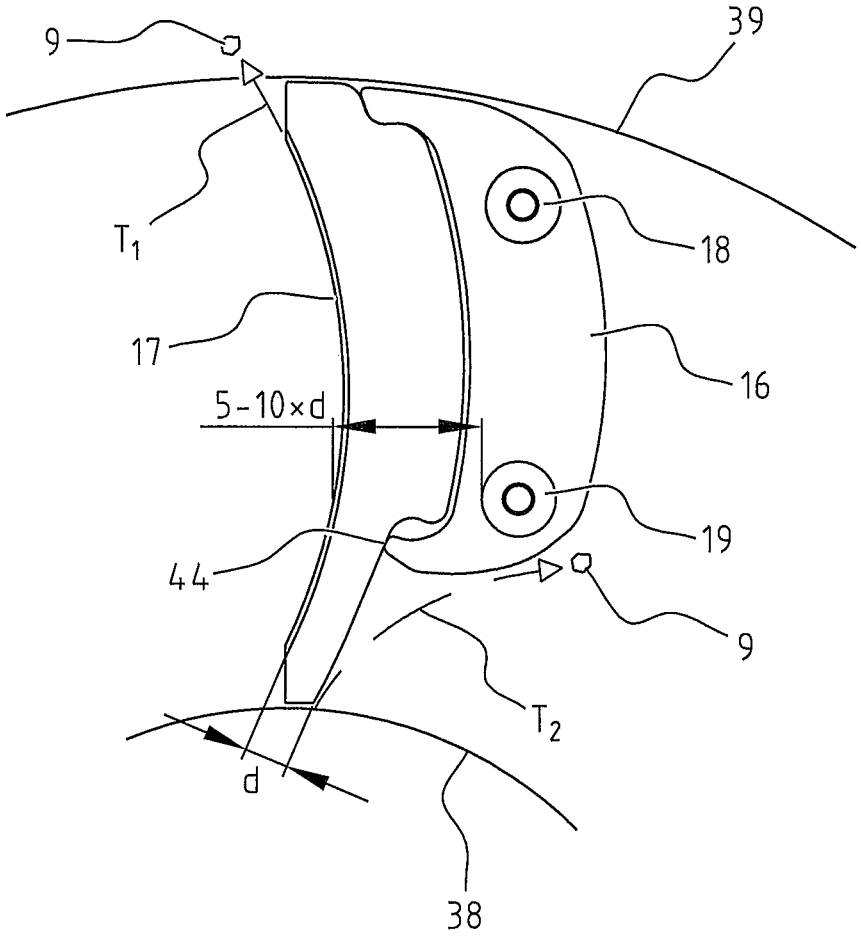
FIG. 8 is a schematic view of the outermost paths through which the grains pass when the turbine is in use.
Figure 8:
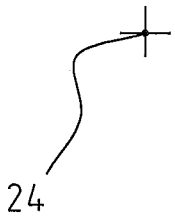

The support element further has a shape such that it suffers relatively little or no adverse effect from the abrasive. On the outer diameter 39 of the turbine the support element follows the circular shape 39 of the turbine so that at least the upper side of the support element undergoes little or no wear. Shown in FIG. 8 are the paths of the abrasive 9 in a coordinate system which co-rotates with the rotation of turbine. The path ($T_1$) of abrasive 9 is shown in the figure at the distal outer end of the blade element. It can be seen from this path that there is a very small risk of damage to the distal part of the support element.

Support element 16 is likewise embodied on the underside such that the path ($T_2$) of abrasive 9 coming from turbine 6 does not make contact with the proximal part of the support element. This results in a greatly reduced chance of wear.

Further shown in FIG. 8 is that the respective shafts 18, 19 with which support element 16 is mounted on the flanges are placed at a significant distance, i.e. more than twice, preferably more than three times the thickness (d) of the blade element (excluding the protruding part 30), behind the guide surface of blade element 17 (as seen in the rotation direction). Shaft 18, but certainly also shaft 19, are positioned at a relatively small distance relative to central axis 24. In a determined embodiment the radial distance between the central axis and each of the mounting points is less than 80% of the radial distance between the central axis and the distal outer end of the blade element.

Because the shafts lie relatively far behind blade element, the shafts are not likely to be affected by the abrasive nevertheless moving along the blade and reaching the support element. The further radially outward the shafts 18, 19 are placed, the greater is the chance that they will eventually be adversely affected by wear (as a result of the increase in the speed in radial direction).

As stated above, the blade element and the support element form a number of mutual line contacts. In the embodiments shown above in the figures, three line contacts are formed in the case where the turbine is stationary and the blade element and the support element are pressed against each other by the fixing means as well as in the case where the turbine is rotating and the centrifugal forces play a part. Two line contacts at the distal outer ends of the blade element and support element and one line contact at the proximal outer end. The line contacts are preferably positioned relative to the mass centre of the blade element such that the blade element is pressed more firmly, and thereby more stably, in the line contacts by the centrifugal forces.

Figure 9:
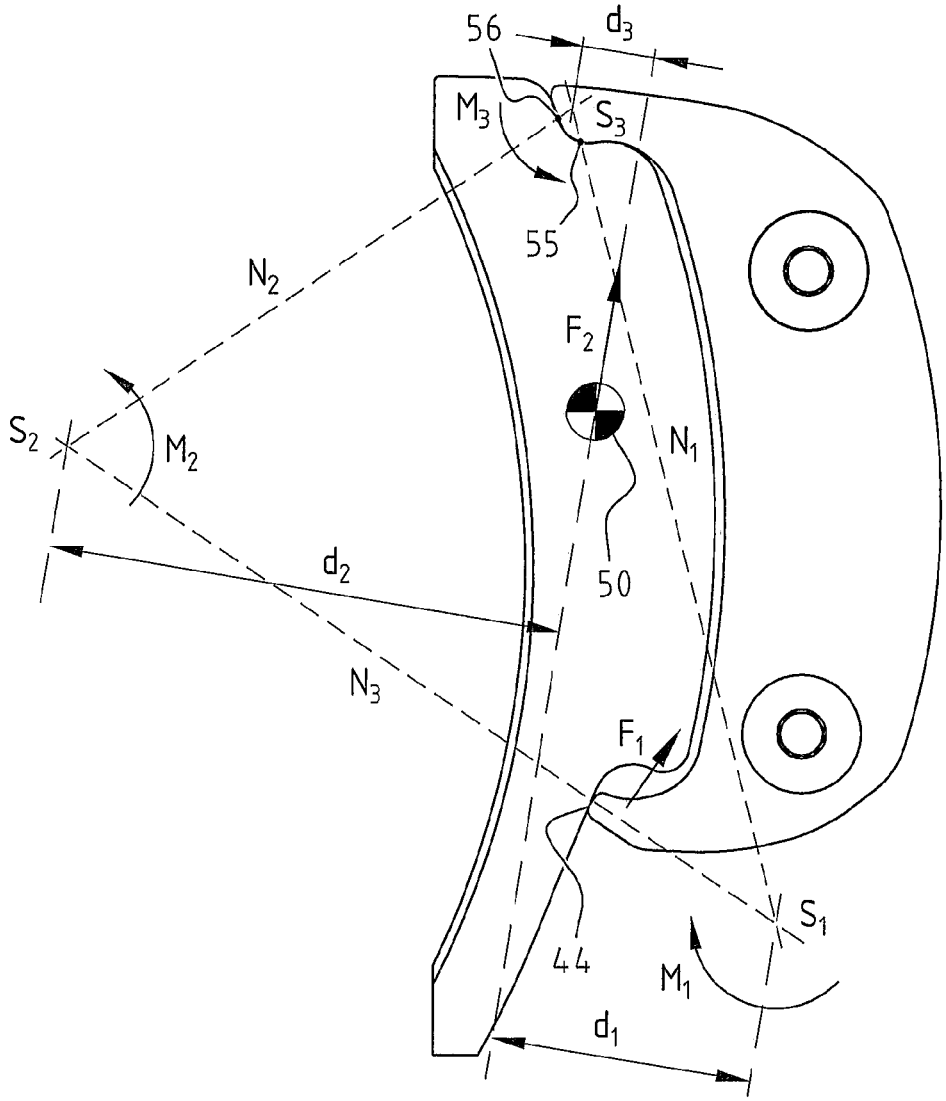
FIG. 9 is a schematic view showing the play of forces on the blade element and the associated support element.

Further illustrated in FIG. 9 is why the blade element 17 can be fixed in stable manner relative to support element 16. In the figure $F_1$ is the biasing force exerted by the above described bolt 39, $F_2$ is the centrifugal force of blade element 17 generated during rotation of turbine 6, the lines $N_1$ to $N_3$ are the normals of the contacts between blade element 17 and support element 16, $S_1$-$S_3$ are the respective imaginary rotation points in the case one of the three contacts has not yet been realized, and $M_1$-$M_3$ are the directions of a moment to be applied in order to realize the third contact. $F_2$ can be described as a moment about intersection $S_1$. The arm of the moment $S_1$ then becomes $D_1$. The direction of this moment about $S_1$ corresponds to the previously determined direction of $M_1$. The direction of $F_2 \times D_2$ about point $S_2$ also corresponds to the direction of $M_2$, just as $F_2 \times D_3$ about point $S_3$ corresponds to the direction of $M_2$. It will be apparent from the figure that, when blade element 17 is formed such that the mass centre 5 relative to the placing point on the upper side of the support element causes a moment which ensures that the blade element is pressed against the support element as a result of the centrifugal force, a stable positioning of the blade is ensured.

Figure 11:
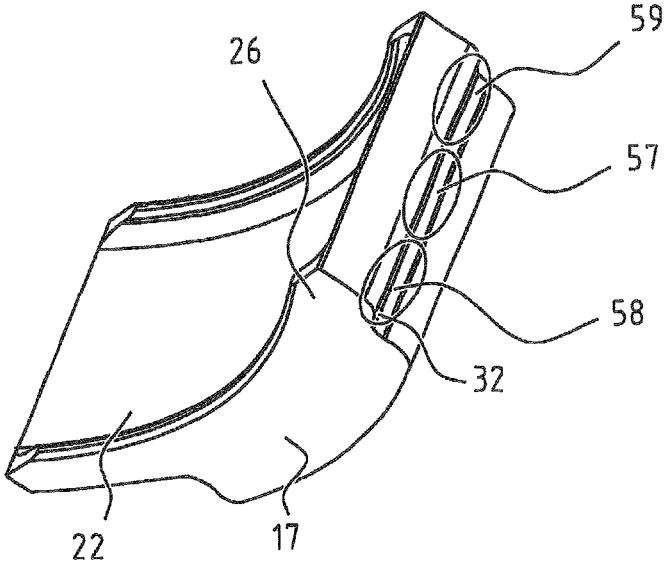
FIG. 11 is a view of an embodiment of a blade element in which different supporting areas are shown.

In other embodiments (not shown) the support element is embodied to support the blade element 17 not over the whole width but only over a part of the overall width. FIG. 11 shows that the blade element can be supported in a central area 57, substantially in the middle of guide surface 22 of blade element 17. No support is then necessary in areas 58, 59 on either side of the central area 57. Peak stresses in the blade element can be reduced or even avoided by supporting the blade element centrally.

As stated herein, a blade can preferably be divided into two components manufactured from different materials. The blade element itself must of course be manufactured from a material which can well withstand wear (also referred to here as wear-resistant material, although total wear resistance cannot be realized in practice). This material is preferably a ceramic material or hard metal. These materials are however relatively brittle, this imposing special requirements for the manufacture and further processing thereof (e.g. arranging through-openings etc.). The dimensional stability of ceramic materials is moreover limited.

When for instance a ceramic material brought into desired shape is fired in a furnace (sintered), there occurs volume shrinkage. Apertures, through-openings etc. possibly arranged in the material before the firing process therefore change in size during the production process. Further processing of ceramic materials, for instance arranging apertures, through-openings and the like after the firing process, is costly and not possible in all cases. The low dimensional stability of ceramic and/or hard metal means in practice that play in the construction must be allowed, which can result in imbalance in the case of a turbine rotating at high speed.

A further drawback is that, while ceramic/hard metal can well withstand compression stresses, they withstand shear and tensile stresses relatively poorly. Shear and tensile stresses can easily result in chippings breaking off and other damage. In the blades according to existing designs a blade is subjected to both compression forces and shear forces, which can result in contradictory requirements of the material to be applied.

According to the embodiments of the invention, these drawbacks are at least partially obviated in that the support element and the blade element are separate elements manufactured from different materials (with different material properties). The specific structural buildup of the support body and the blade element moreover ensures in determined embodiments that mainly compression stresses occur in the blade element and mainly shear stresses in the support element. Ceramic material which can withstand wear and compression stresses relatively well but withstands shear stresses relatively poorly (because of the chance of chipping off of material parts) is utilized for the blade element, while other tougher materials, such as optionally (hardened) steel/metal alloy, is utilized for the support body. Steel/metal alloy can for instance withstand shear forces better than ceramic. A steel support element can moreover be manufactured more easily and with a greater dimensional stability.

In an embodiment of the invention the blade element 17 is manufactured from relatively wear-resistant material, such as for instance tungsten carbide. The support element can for instance be manufactured in this embodiment from another material such as hardened steel or from a similar material.

The present invention is not limited to the embodiments thereof described herein. The rights sought are rather defined by the following claims, within the scope of which many adaptations and modifications can be envisaged.

The invention claimed is:

1. A turbine for a machine for projecting abrasive for the surface treatment of objects, wherein the turbine comprises a turbine wheel rotatable about a central axis, the turbine wheel comprising:

a first flange and a second flange, wherein at least one of the flanges is provided with a supply opening along which the abrasive can be supplied;

at least one blade element arranged between the first and second flanges and provided with a guide surface for receiving, guiding and projecting the abrasive supplied via the supply opening; and a mounting system for releasable mounting of the blade element, wherein the mounting system comprises:

a support element which is arranged between the blade element and the flanges and which is mounted releasably on the blade element and on each of the flanges, wherein the support element is arranged at a position behind the blade element and is embodied to support the blade element at least in an area located centrally between the flanges and wherein the support element is embodied to support the blade element over the whole width.

2. The turbine as claimed in claim 1, wherein the support element has one or more through-openings and wherein mounting elements are placed in one or more of the through-openings for the purpose of mounting the support element on both flanges, wherein the one or more mounting elements are wholly enclosed by the support element in the space between the flanges, or wherein the support element with mounting elements forms substantially the only coupling between the two flanges.

3. The turbine as claimed in claim 2, wherein the support element comprises an edge part positioned at the distal outer end relative to the central axis, wherein the edge part forms a stop against which the blade element rests in operative state, and wherein the one or more through-openings are arranged at a distance of at least the diameter of the through-opening relative to the stop.

4. The turbine as claimed in claim 1, wherein the blade element is manufactured substantially from a material other than that of the support element, wherein the blade element is preferably manufactured from a relatively wear-resistant and thus brittle material, and wherein the support element is manufactured from a relatively tough material.

5. The turbine as claimed in claim 1, wherein the surface of the support element remote from the blade element takes a substantially smooth or rounded form.

6. The turbine as claimed in claim 1, wherein the distal outer end of the support element relative to the central axis has a free first end surface, the normal of which extends radially or obliquely to the rear or has a second end surface which is wholly shielded by the blade element and the normal of which extends forward.

7. The turbine as claimed in claim 1, wherein the support element comprises a first edge part, central part and second edge part manufactured integrally, wherein the first and second edge parts extend respectively at a distal position and proximal position relative to the central axis, wherein the first edge part forms a stop against which the blade element rests during operation, and wherein the first edge part and the corresponding part of the blade element are preferably formed so as to make one or more line contacts in operative state.

8. The turbine as claimed in claim 1, further comprising fixing means for fixing the blade element relative to the support element, wherein the fixing means are provided at the position of the second edge part, wherein the fixing means preferably comprise a spring for fixing the blade element under spring tension to the support element or wherein the fixing means preferably comprise an opening with associated fixing pin provided in the support element.

9. The turbine as claimed in claim 1, wherein the blade element is supported at a maximum radius relative to the central axis by the support element or wherein the distal outer ends of the support element and the blade element relative to the central axis have end surfaces extending substantially mutually in line, and wherein the end surfaces are preferably substantially aligned with the peripheral edges of the flanges.

10. The turbine as claimed in claim 1, wherein the width of the support element substantially corresponds to the intermediate distance between the flanges, or wherein the blade element and support element are embodied for exchange of the blade element in a situation where the support element is mounted on the flanges.

11. The turbine as claimed in claim 1, wherein the support element comprises on the side facing toward the blade element a recess into which a protruding part of the blade element can be at least partially received.

12. The turbine as claimed in claim 1, wherein the support element is mountable at least at one mounting point on a flange and wherein the mounting point is located in the operative state at a distance of more than twice the thickness of the blade element relative to the guide surface of the blade element.

13. A support element of a turbine as claimed in claim 1.

14. A machine for projecting abrasive, comprising:

at least one turbine as claimed in claim 1; and a drive for rotatable driving of the turbine wheel, wherein the drive comprises an electric motor connected to a drive shaft of the turbine.

15. A turbine for a machine for projecting abrasive for the surface treatment of objects, wherein the turbine comprises a turbine wheel rotatable about a central axis, the turbine wheel comprising:

a first flange and a second flange, wherein at least one of the flanges is provided with a supply opening along which the abrasive can be supplied;

at least one blade element arranged between the first and second flanges and provided with a guide surface for receiving, guiding and projecting the abrasive supplied via the supply opening;

a mounting system for releasable mounting of the blade element, wherein the mounting system comprises:

a support element which is arranged between the blade element and the flanges and which is mounted releasably on the blade element and on each of the flanges, wherein the support element is arranged at a position behind the blade element and is embodied to support the blade element at least in an area located centrally between the flanges and wherein the support element is embodied to support the blade element over substantially the whole width; and wherein the support element comprises a first edge part extending at a distal position relative to the central axis, wherein the first edge part forms a stop against which the blade element rests during operation.

16. The turbine as claimed in claim 15, wherein the first edge part and the corresponding part of the blade element are formed so as to make one or more line contacts in an operative state, and wherein the line contacts are over the whole width of the blade element.

17. The turbine as claimed in claim 3, wherein the one or more through-openings are arranged at a distance of at least twice the diameter of the through-opening relative to the stop.

18. The turbine as claimed in claim 3, wherein the one or more through-openings are arranged at a distance of at least three times the diameter of the through-opening relative to the stop.

19. The turbine as claimed in claim 11, wherein the form of the recess substantially corresponds to the form of the protruding part.

20. The turbine as claimed in claim 12, wherein the mounting point is located in the operative state at a distance of more than three times the thickness of the blade element relative to the guide surface of the blade element.

21. The turbine as claimed in claim 12, wherein the mounting point is located in the operative state at a distance of between five and ten times the thickness of the blade element relative to the guide surface of the blade element.

22. The turbine as claimed in claim 15, wherein the first edge part forms a stop defining a concave surface against which the blade element rests during operation.

* * * * *